United States Patent [19]

Whitefield

[11] 4,184,403

[45] Jan. 22, 1980

[54] METHOD AND APPARATUS FOR INTRODUCING DYNAMIC TRANSIENT VOICES IN AN ELECTRONIC MUSICAL INSTRUMENT

[75] Inventor: John T. Whitefield, Harleysville, Pa.

[73] Assignee: Allen Organ Company, Macungie, Pa.

[21] Appl. No.: 852,493

[22] Filed: Nov. 17, 1977

[51] Int. Cl.[2] ..... G10H 3/00

[52] U.S. Cl. ..... 84/1.11; 84/1.19; 84/1.26

[58] Field of Search ..... 84/1.11, 1.12, 1.19, 84/1.21, 1.22, 1.26

[56] References Cited

U.S. PATENT DOCUMENTS

| | | | |
|---|---|---|---|
| 3,610,799 | 10/1971 | Watson | 84/1.26 X |
| 3,913,442 | 10/1975 | Deutsch | 84/1.11 X |
| 4,122,742 | 10/1978 | Deutsch | 84/1.11 |

*Primary Examiner*—Ulysses Weldon

*Attorney, Agent, or Firm*—Seidel, Gonda, Goldhammer & Panitch

[57] ABSTRACT

A method and apparatus for introducing transient voices in an electronic musical instrument. It is the nature of some musical instruments such as a piano, harpsichord, or guitar to produce tones having a transient characteristic; however, instruments such as the trumpet, clarinet and pipe organ, which are considered to produce steady state tones, also exhibit transient characteristics at times. In general, transient effects in musical instruments can be characterized as combinations of harmonic and amplitude variations over some time period.

In order to more closely synthesize the sounds of musical instruments, the present invention employs a scheme whereby a sequence of voices, which may have different harmonic and amplitude characteristics, are generated during the transient time period. This is accomplished through the use of a transient voice memory divided into "n" voice zones. Each zone may contain the same or a different voice from every other zone in the memory. The use of multiple memories is also possible if desired. The present invention is particularly suited for use in digital electronic musical instruments which generate attack and decay scale factors in response to key depression and release. Using the instrument's attack and decay counter means in conjunction with an attack and decay zone decoder, one or more voice memory zones are selected from the respective memories for combining with the normal voice associated with the desired sound. The combined voice is then processed through the instrument in the usual fashion.

18 Claims, 12 Drawing Figures

METHOD AND APPARATUS FOR INTRODUCING DYNAMIC TRANSIENT VOICES IN AN ELECTRONIC MUSICAL INSTRUMENT

BACKGROUND OF THE INVENTION

1. Field of the Invention

This invention resides broadly in the field of electronic musical instruments, and is particularly adaptable for use in instruments employing a digital selection system for calling forth desired tones and voices from those available to be produced by the instrument. The principles of the present invention are applicable to electronic musical instruments in which musical sounds are generated in response to the actuation of key switches regardless of whether those switches are actuated directly, i.e., by the musician's fingers, or indirectly, by the plucking of strings. The term key is used in a generic sense, to include depressible levers, actuable on-off switches, touch or proximity responsive devices, closable apertures and so forth. The present invention relates to the characteristics of a musical note played on an electronic musical instrument. More particularly, the present invention relates to the transient voices which are dynamic in terms of amplitude and harmonics and often bear little resemblance to the final steady state tone normally associated with the instrument.

2. Description of the Prior Art

Heretofore, efforts to generate the characteristic transient voices of tones produced by electronic musical instruments have generally taken two approaches. The first approach employs a memory for storage of sampled waveform information to provide a single dynamically non-changing transient voice for the purpose of simulating chiff tone characteristics. Upon key actuation, the voice is read from memory and combined with other selected tones. This approach lacked flexibility since there could be no variation in voices during the transient time period. The second approach is to modulate the harmonic content of the transient voice as a function of time by computing in real time the amplitude contributions of constituent Fourier components. This system permitted amplitude and harmonic variation but does not utilize stored sampled amplitude waveform information.

In accordance with the present invention there is provided a method and apparatus for introducing variations in amplitude and harmonic content of the characteristic transient of tones produced in electronic musical instruments.

SUMMARY OF THE INVENTION

The present invention provides a new and unobvious means for achieving transient voice effects in an electronic musical instrument. Briefly, in accordance with the present invention there is provided a zone decoder which divides the transient voice period into "n" zones. Each zone may contain the same or different transient voice tones.

In an electronic musical instrument upon depression or release of a key, a key depressed signal or a key released signal is applied to a counter clear pulse generating means. In response to either key signal, a counter clear pulse generating means produces a clear pulse, which is applied to an attack/decay counter. The attack/decay counter is thereby cleared to zero count. A continuous running attack/decay counter signal source applies a counter advance signal to the attack/decay counter. The output of the attack/decay counter which constitutes attack/decay addresses is applied simultaneously to an address to scale factor converter, an attack/decay zone decoder and a maximum count decoder. The address to scale factor converter outputs scale factors to control the amplitude of the selected note during the attack and decay period. A maximum count decoder, a common component in the art, upon reaching a predetermined maximum count, produces a disable signal for terminating the output of the attack-/decay counter. The disable signal from the maximum count decoder is simultaneously applied to a transient effect enabling means, the purpose of which is to permit control over the transient voice effect. The attack-/decay zone decoder in response to the attack/decay address signal will divide the attack and/or decay period into predetermined "n" zones and output a transient voice address signal for calling forth the selected zone or voice from the transient voice memory. The transient voice memory in response to the transient voice address signal from the attack/decay zone decoder, sample point addresses from the instrument's normal tone generator assignment logic, and the enable signal from the transient effect enabling means will output transient voice sample point data which is presented to an adder for combining with the regular voice sample point data output by regular voice memory before propagation to the audio ouput. Additionally, a means for employing multiple transient voice is disclosed.

BRIEF DESCRIPTION OF THE DRAWINGS

For the purpose of illustrating the invention, there are shown in the drawings forms which are presently preferred; it being understood, however, that the invention is not limited to the precise arrangement and instrumentalities shown.

DESCRIPTION OF THE PREFERRED EMBODIMENT

The following detailed description is of the best presently contemplated modes of carrying out the present invention. This description is not intended in a limiting sense, but is made solely for the purpose of illustrating the general principles of the invention.

Figure 1:
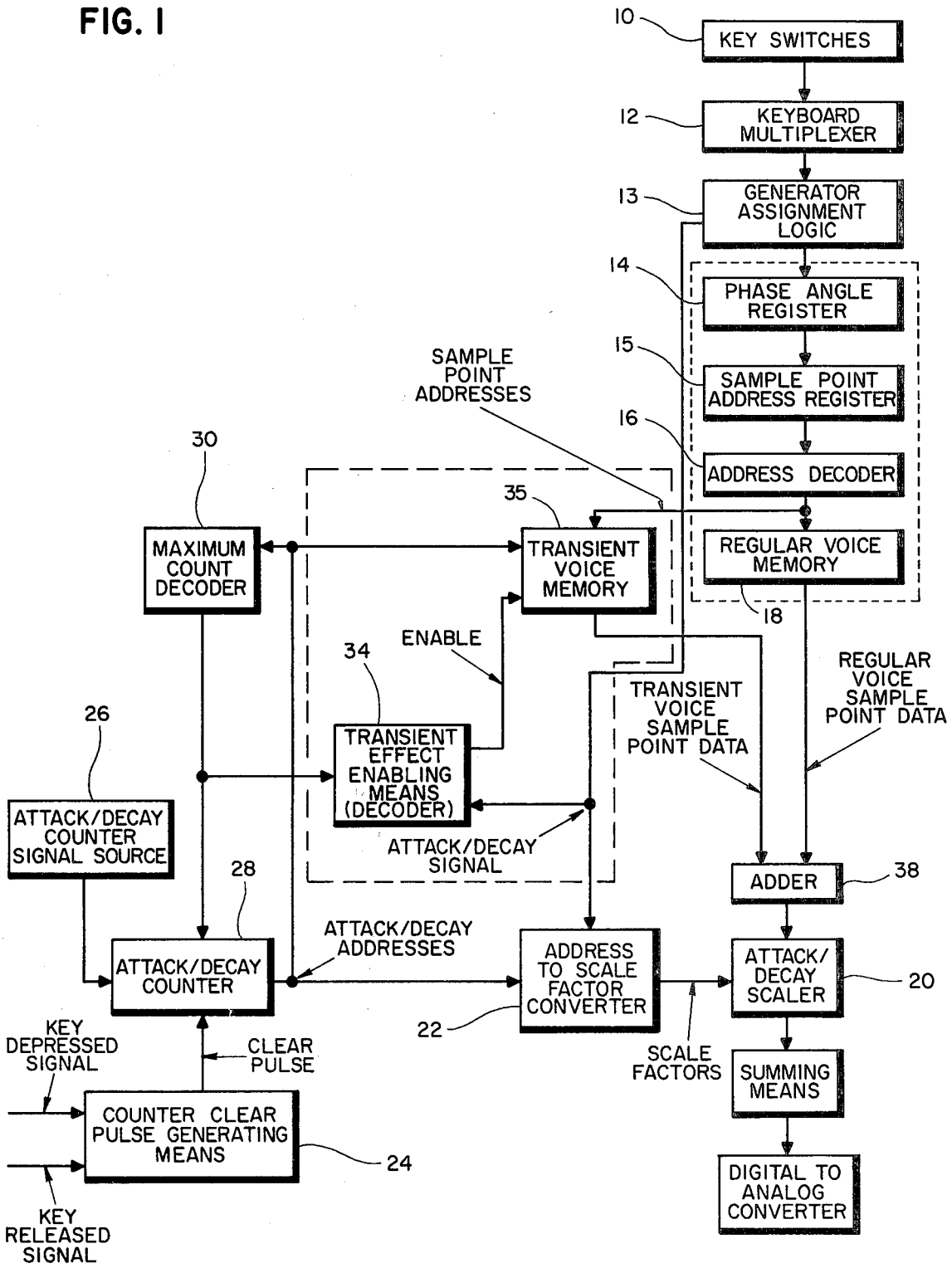
FIG. 1 is a block diagram of an electronic musical instrument embodying an apparatus for introducing dynamic transient voices in accordance with the present invention.
Figure 4:
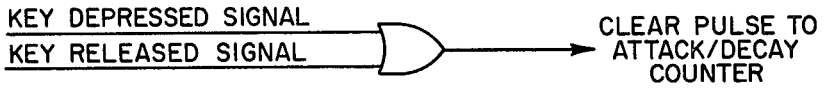
FIG. 4 is a logic diagram of a counter clear pulse generating means suitable for use in the present invention.

Referring now to the drawings in detail, wherein like numerals indicate like elements, there is shown in FIG. 1 a schematic diagram, in block form, of an electronic musical instrument embodying the present invention. An electronic musical instrument or digital electronic musical instrument in which the present invention may be applied and used are described in detail in U.S. Pat. No. 3,610,799, of which the inventor was George A. Watson. Reference may be had to this patent for detailed descriptions of components referred to herein other than the instant invention producing structural relationships in accordance with the invention. In FIG. 1 there is shown a keyboard 10 composed of a plurality of key switches or keys. The key switches or keys are used in the generic sense and will be referred to herein as keys, being the keys of various electronic musical instruments. The activity of a key on keyboard 10 is encoded in a time-division multiplexed format by Keyboard Multiplexer 12. The multiplexed signal encoded by Keyboard Multiplexer 12 is presented to Generator Assignment Logic 13. One function of Generator Assignment Logic 13 is to capture a multiplexed channel of the audio waveshape generator, in behalf of the active key as indicated by the multiplexed encoding signal from Keyboard Multiplexer 12. That portion of FIG. 1 enclosed by dashes represents a simplified audio waveshape generator as disclosed in U.S. Pat. No. 3,610,799. The time division relationship between the multiplexed signal of Keyboard Multiplexer 12 and the multiplexed channels of the Audio Wavehshape Generator typically allots a time slot of 12$\mu$ seconds to each key of the keyboard, and the audio waveshape generator typically has twelve multiplexed channels, each channel being allocated a time slot of 1$\mu$ second. Therefore, during the time slot period of any key there are twelve individual multiplexed channels available for capture. Referring now to FIG. 1, Attack/Decay Counter Signal Source 26 may be a repetitive square wave signal which is proportioned to the audio frequency of the associated note, or a repetitive square wave which is frequency adjustable but remains constant over the entire keyboard. In the first case the signal source could be one of the sample point addresses from Address Decoder 16 of FIG. 1, and in the second case the signal source could be a multivibrator, which is familiar to those skilled in the art. In the preferred embodiment, Attack/Delay Counter 28 is a 32 state counter; however, the number of states could be any practical value; the more states the better resolution or smoothness of note amplitude during the attack and decay. The signal from Attack-/Decay Counter Signal Source 26 provides a counter advance signal which is applied to Attack/Decay Counter 28. A clear pulse from Counter Clear Pulse Generating Means 24 provides for the resetting of Attack/Decay Counter 28. FIG. 4 is a simple embodiment of a Counter Clear Pulse Generating Means suitable for use in the present invention. The key depressed signal and the key released signal are signals available from Generator Assignment Logic 13 of FIG. 1. These signals are simply indications of the key activity and may be generated in a number of ways. One method of generating these signals in a manner compatible with the present invention is disclosed in U.S. Pat. No. 3,610,799. The count from Attack/Delay Counter 28 is simultaneously applied to Maximum Count Decoder 30, Transient Voice Memory 35, and Address to Scale Factor Converter 22.

Maximum Counter Decoder 30 between zero count and a predetermined maximum count minus one will provide a logic "1" simultaneously to Attack/Decay Counter 28 and to Transient Effect Enabling Means 34. Upon reaching the predetermined maximum count, Maximum Count Decoder 30 will output logic "0" which will simultaneously disable Attack/Decay Counter 28 and Transient Effect Enabling Means 34. Thus, there is a feedback loop whereby the Attack-/Decay Addresses generated by Attack/Delay Counter 28 are decoded in Maximum Count Decoder 30 and a disable signal output is generated upon a predetermined count. This provides a simple means for synchronizing the present invention with the normal function of the instrument.

Figure 3:
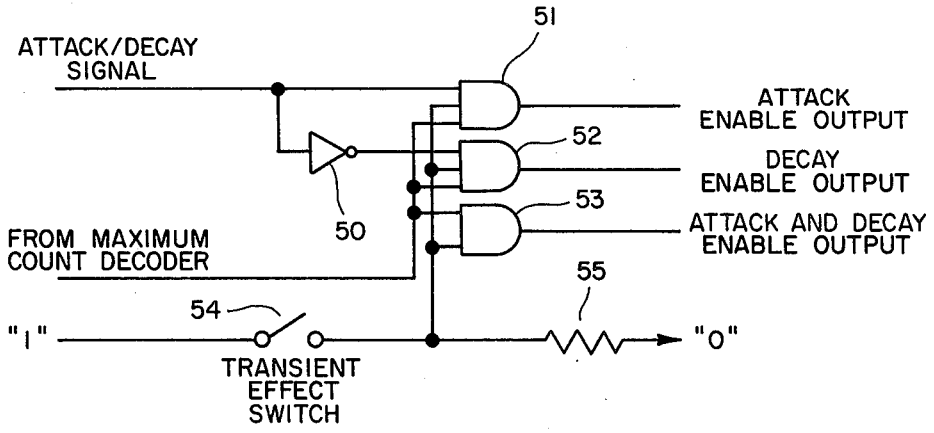
FIG. 3 is a block diagram of a transient effect enabling means (decoder) suitable for use in the present invention.

Transient Effect Enabling Means (decoder) 34 of FIG. 1 provides a decoder means for selecting the mode or modes during which Transient Voice Memory 35 of FIG. 1 will have an output. FIG. 3 is the logic diagram for Transient Effect Enabling Means 34 of FIG. 1 as presently utilized in the preferred embodiment. The function of Transient Effect Enabling Means 34 is related to the instrument Attack/Decay Signal.

To facilitate an understanding of Transient Effect Enabling means 34, the characteristics of an attack-/decay signal as utilized in the preferred embodiment of the present invention will be defined as follows. The attack/decay signal is a digital signal whose logical states are used to distinguish the attack mode from the decay mode. For example, the attack/decay signal could be such that a logic "1" would represent the attack mode and logic "0" the decay mode. In the normal organ mode, that in which the instrument produces a sound as long as the key remains depressed, the signal assumes a logic "1" upon key depression and remains at logic "1" until the key is released. Upon key release the signal assumes logic "0" and the sound level decreases to zero. In the piano or percussion mode, that in which the instrument responds to a key depression such that the audible effect is one of rapidly rising attack to full scale followed immediately by decay, the attack/decay signal assumes logic "1" during the attack and after reaching full scale assumes logic "0" thereby causing decay. A detailed explanation of the Attack/Decay Signal and a means of generating a signal compatible with the preferred embodiment may be found in U.S. Pat. No. 3,610,799.

With the above characteristics in mind, it becomes possible to further describe the function of Transient Effect Enabling Means 34 of FIG. 1. The Attack-/Decay Signal is applied directly to "AND" gate 51 and after inversion in inverter 50 is applied to "AND" gate 52. The output of Maximum Count Decoder 28 of FIG. 1 is applied simultaneously to "AND" gates 51, 52, and 53. A D.C. power supply representative of a logic "1" level is provided to "AND" gates 51, 52, and 53 via Transient Effect Switch 54. When switch 54 is closed, the level "1" is applied to "AND" gates 51, 52 and 53, and when opened, a level "0" is applied to "AND" gates 51, 52, and 53. The "0" level is assured by virtue of resistor 55 going to "0" level.

The operation of Transient Effect Enabling Means (decoder) 34 of FIG. 1 is easily understood. The Attack/Decay Signal during the attack period is a level "1". Since maximum count has not yet been decoded, the signal from Maximum Count Decoder 30 of FIG. 1 is a level "1". Closing Transient Effect Switch 54 provides a level "1". This combination results in "AND" gate 51 having a level "1" output, which will enable Transient Voice Memory 35 of FIG. 1. As explained herein above, the Attack/Decay Signal during the decay period is a level "0". Therefore, "AND" gate 51 will not have a level "1" output during decay mode. However, due to Inverter 50 "AND" gate 52 will now output the enable signal to Transient Voice Memory 35 during the decay period. In the case where the transient voice effect is desired during both attack and decay periods, there is no need to decode the Attack/Decay Signal. The signal from Maximum Count Decoder 34 of FIG. 1 and the level "1" from Transient Effect Switch 54 only are applied to "AND" gate 53 which will output an enable signal during both attack and decay.

Figure 3A:
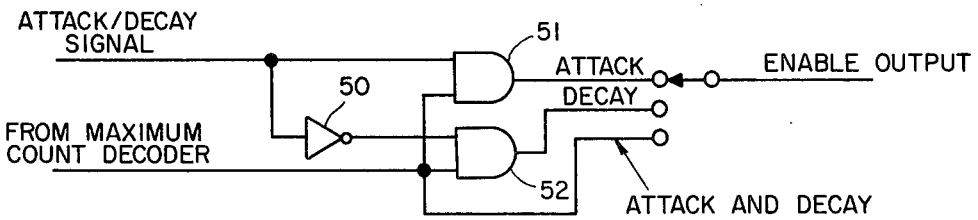
FIG. 3A is a block diagram of an alternative transient effect enabling means suitable for use in the present invention.

It will be obvious to one skilled in the art that an external selection switch may be provided to allow the player to select the desired transient effect. In addition, it should be obvious that Transient Effect Switch 54 is not an essential component and is used as an engineering consideration to avoid possible interference from electrical noise in the environment. A simpler Transient Effect Enabling Means is shown in FIG. 3A.

Transient Voice Memory 35 of FIG. 1, in the preferred embodiment, is a programmable read only memory which is a readily available commercial component, i.e., Intel Corporation PROM, Type 1702. A non-programmable read only memory, such as Intel Corporation ROM, Type 1302, could be used in the present invention. However, in the preferred embodiment the flexibility available with a programmable memory is desired. Transient Voice Memory 35 has a capacity for holding "n" different voices. For the purpose of this disclosure, the preferred embodiment has a four zone memory. The decoding logic for segmenting the memory into four zones is contained within Transient Voice Memory 35 as part of the normal address decoding logic. The two most significant address bits from Attack/Decay Counter 28 of FIG. 1 are connected to their respective most significant address bits in Memory 35 for use as coded zone inputs. This decoding effects a sequential addressing or enabling of each zone of the memory individually, thereby calling out the voice information contained in the respective zone. Within a given zone, Memory 35 is further divided into sample point data locations which are accessed by the lower order address bits. This bit information is provided by the Address Decoder 16 of FIG. 1 and is labeled as Sample Point Addresses. As stated herein above, Transient Effect Enabling Means 34, in response to Maximum Count Decoder 30 and the Attack/Decay Signal, will output an enable signal from the selected "AND" gate which will enable Transient Voice Memory 35. Once enabled, each zone of the memory is decoded and each sample point within a zone is decoded, thereby resulting in the output of Transient Voice Sample Point Data as called for by the Sample Point Addresses.

Figure 1A:
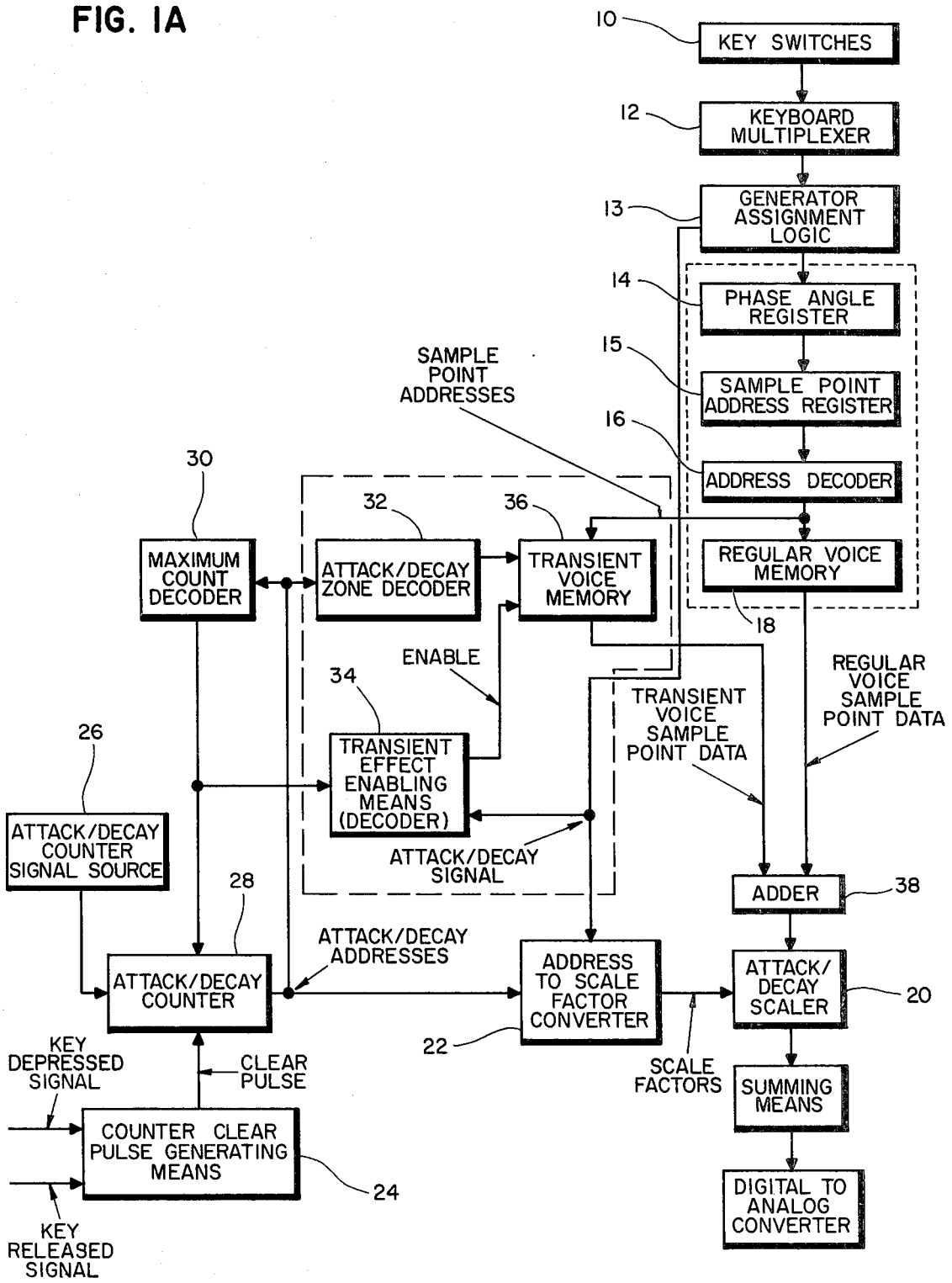
FIG. 1A is a block diagram of an electronic musical instrument embodying an alternative apparatus in accordance with the present invention.
Figure 1B:
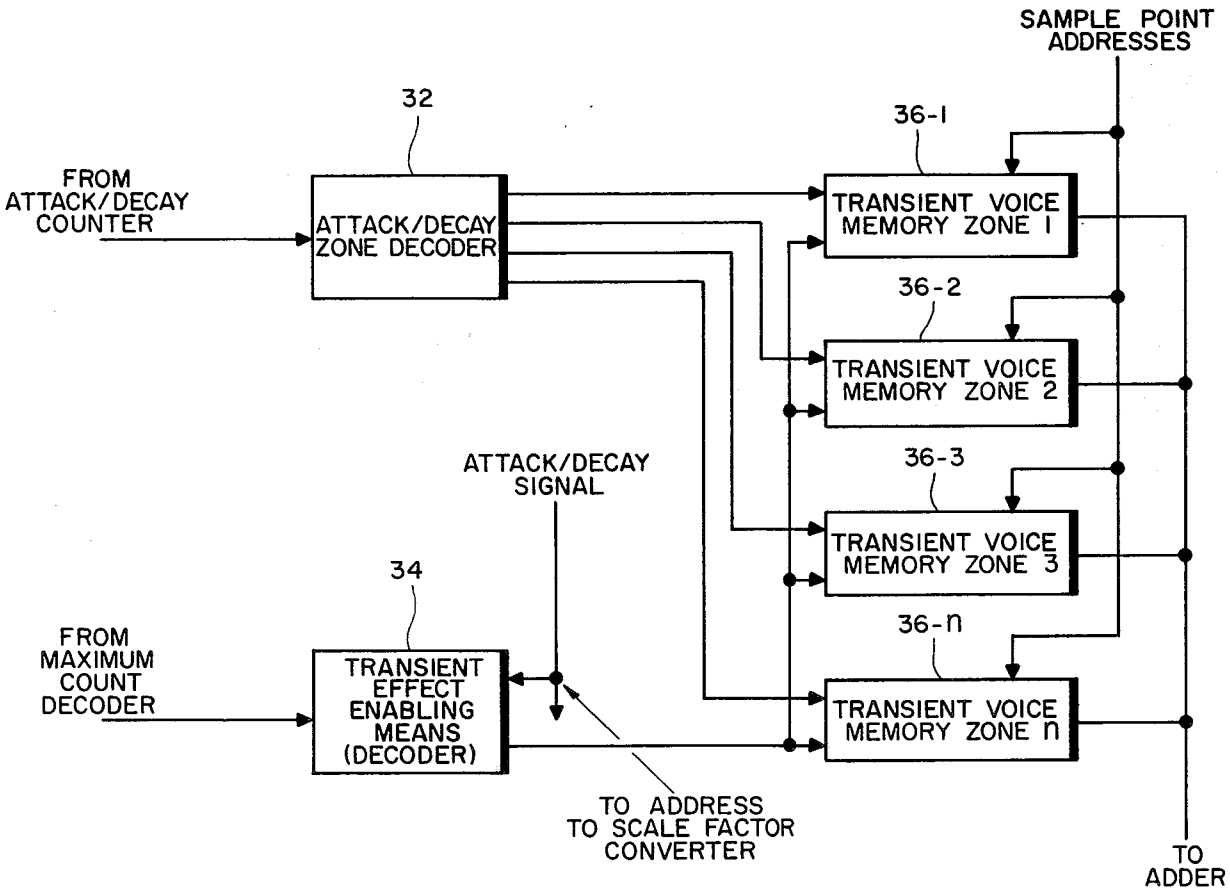
FIG. 1B is an expanded block diagram of the alternative apparatus shown in FIG. 1A.
Figure 2:
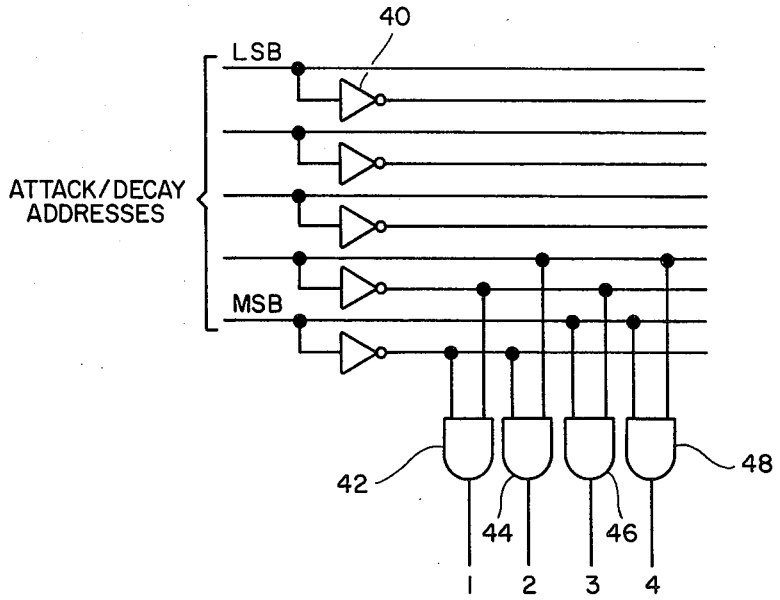
FIG. 2 is a block diagram of a zone decoder suitable for use in the alternative embodiment of the present invention.

An alternate embodiment of Transient Voice Memory 35 is shown in FIG. 1A. In this embodiment an Attack/Decay Zone Decoder 32 has been inserted before the Transient Voice Memory 36. Transient Voice Memory 36 is further shown in FIG. 1B as being multiple memories. The number of memories may be any number up to "n" since there are to be "n" zones as decoded in Attack/Decay Zone Decoder 32 of FIG. 1A. The Attack/Decay addresses are inputted into Attack/Decay Zone Decoder 32 in the same manner as they are inputted to Transient Voice Memory 35 of FIG. 1. FIG. 2 is one possible embodiment of Attack/Decay Zone Decoder 32. The five bit attack/decay addresses from Attack/Decay Counter 28 in FIG. 1 are decoded using a method familiar in the art. Decoding the two most significant bits is sufficient to divide the total count of the transient period into four zones. If more zones are desired, additional bits may be decoded. Hence, decoding the three most significant bits would divide the transient period into eight zones. In the present embodiment, decoding all five bits would produce thirty-two zones. While the number of zones is a practical consideration, it is theoretically possible to achieve "n" zones, where "n" is equal to the number of states of Attack/Decay Counter 28.

The outputs of Attack/Decay Zone Decoder 32 are applied to the respective zone memories 36-1 through 36-n which receive in common the output of Transient Effect Enabling Means 34. Each memory will output the Transient Voice Sample Point Data for the associated zone as called for by the Sample Point Addresses. The Transient Voice Sample Point Data from the transient voice memory (ies) is combined with the instrument's Regular Voice Sample Point Data in Adder 38 of FIG. 1, and the combined signal is applied to one input of Attack/Decay Scaler 20 of FIG. 1. Adder 38 may be any arithmetic function; however, in the preferred embodiment it has been determined that the addition of the transient voice data is more desirable.

It is also possible to use the present invention without the addition or summing with regular voice information. For example, if it were found desirable to have a memory dedicated to a particular instrument, say a trumpet, the output of the transient voice memory could be applied directly to Attack/Decay Scaler 20 of FIG. 1, or the regular voice output could be shunted off before Adder 38 of FIG. 1. In this embodiment the zones of the memory would function as described herein and would contain only voice information for the designated instrument. Thus, memory zones one through "n-1" would contain the transient voice of the instrument and the nth zone would contain the steady state voice.

The Scale Factors from Address to Scale Factor Converter 22 of FIG. 1 are applied to the other input of Attack/Decay Scaler 20. The function of Address to Scale Factor Converter 22 is to provide scale factors which go from "0" state to the "1" state during attack periods and from the "1" state to the "0" state during decay periods. The converter is necessitated by the nature of the Attack/Decay Addresses from Attack/Decay Counter 28 of FIG. 1. The Attack/Decay Addresses are such that when a key is actuated to begin the attack period or is released to begin the decay period, the addresses begin at the "0" state and increase in a binary fashion until the all "1" state is reached. This is easily understood considering that Attack/Decay Counter 28 is a common binary counter and that Counter Clear Pulse Generation Means 24 of FIG. 1 is simply an "OR" gate which received the key depressed or key released signal and outputs a logic "1" in response thereto. It therefore becomes obvious that the counter output does not discriminate between attack and decay periods.

Figure 5:
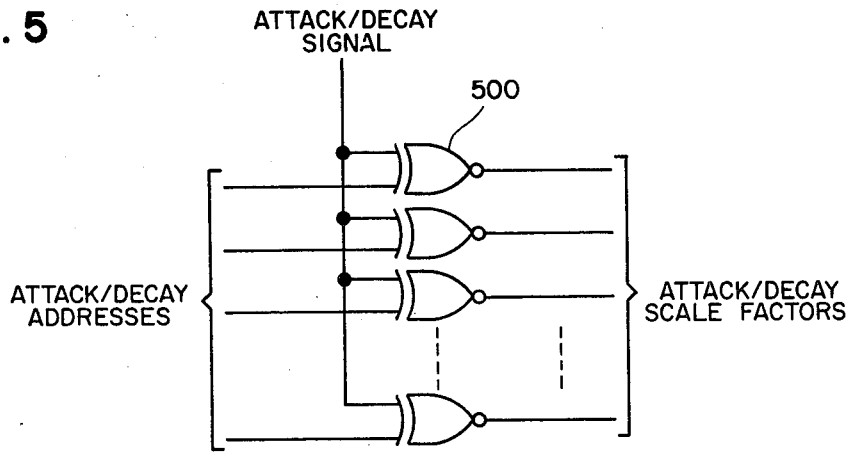
FIG. 5 is a logic diagram of an address to scale factor converter suitable for use in the present invention.
Figure 5A:
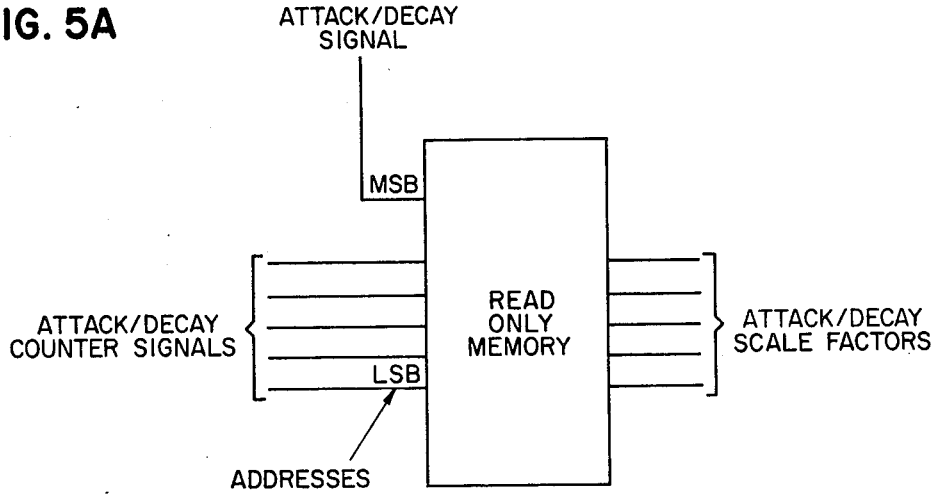
FIG. 5A is a block diagram of an alternative embodiment for an address to scale factor converter.

FIGS. 5 and 5A illustrate alternative methods of achieving scale factors which increase during attack periods and decrease during decay periods. In FIG. 5 the attack and decay addresses from the counter are applied to the one input of exclusive NOR gates 500. The second input to exclusive NOR gates 500 is the attack and decay signal which is a "1" during attack and a "0" during decay. During the attack time the exclusive NOR gates 500 function as non-inverting elements and thus the resulting scale factor outputs are identical to the address inputs. During the decay time the exclusive NOR gates function as inverting logic elements and thus present scale factors which go from the all "1" state to the all "0" state as the input addresses go from all "0" to all "1". This implementation results in a linear progression of scale factors for both attack and decay. FIG. 5A uses a read only memory to accomplish the conversion. In this case the addresses from the counter address the memory which contains the desired progression of scale factors. A two section memory is used with one section storing the attack scale factors and the other storing the decay scale factors. The selection of the attack scale factors or decay scale factors is accomplished by the most significant bit address of the memory which is driven by the attack/decay signal. This implementation allows for non-linear as well as linear scale factor progressions.

Attack/Decay Scaler 20 of FIG. 1 is a multiplier which will be familiar to those skilled in the art. The function of the Attack/Decay Scaler is to assure a smooth progression in note amplitude from 0 to full scale during attack and from full scale to 0 during decay. In essence the attack Scale Factors are increasing fractional values which are multiplied with full amplitude regular voice sample point data to achieve note attack; the decay Scale Factors are decreasing fractional values which are multiplied with full amplitude regular voice sample point data to achieve note decay. The signal output by Attack/Decay Scaler 20 is treated in the usual fashion.

Figure 6:
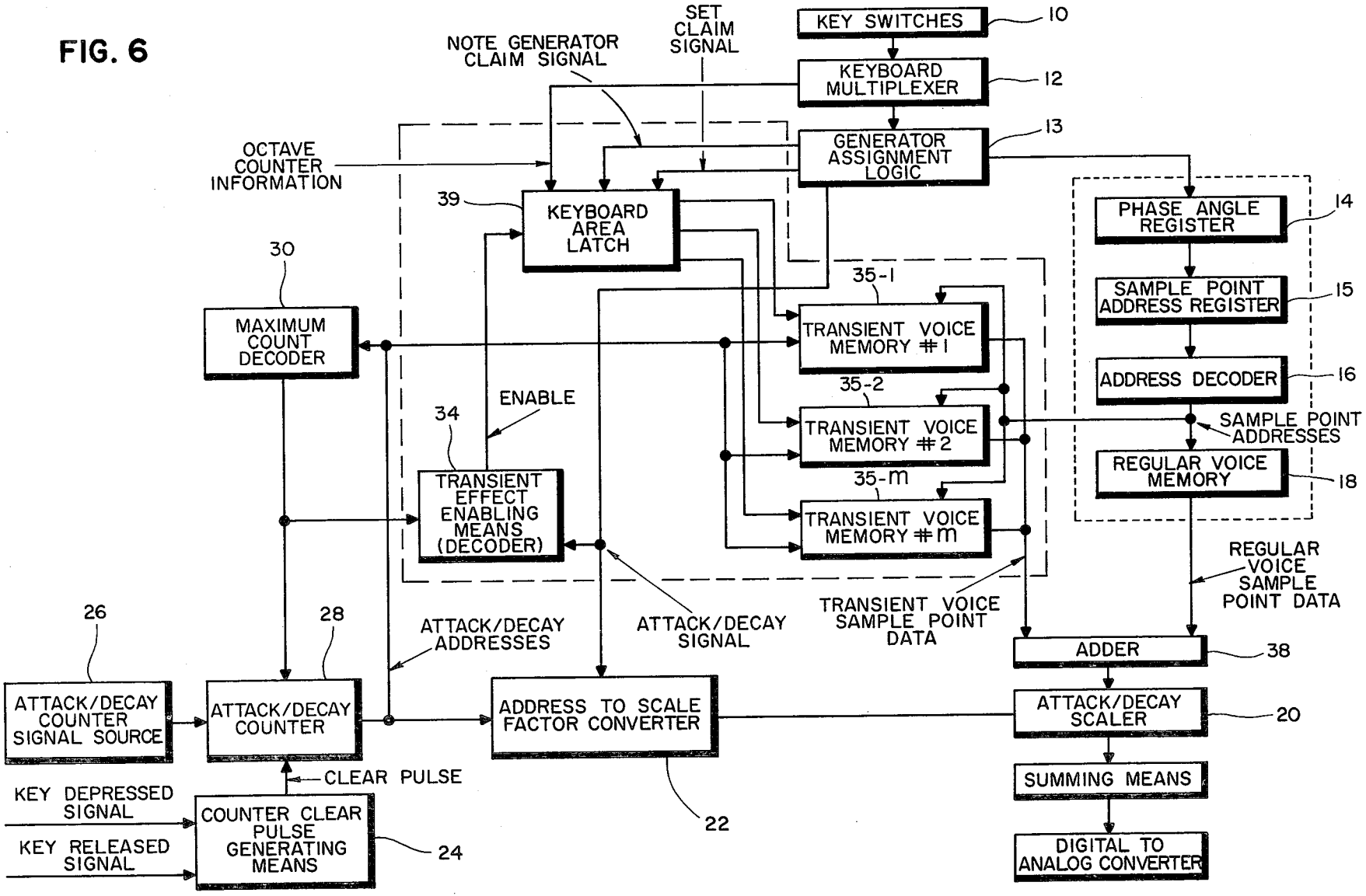
FIG. 6 is a block diagram of an electronic musical instrument employing multiple transient voice memories in accordance with the present invention.

Frequently it is desirable to have more than one set of transient voices available in a given instrument. FIG. 6 is a block diagram of an electronic musical instrument employing "m" different transient voice memories. In electronic musical instruments having more than one transient voice set, it is often desirable to have different keyboards or different areas within a keyboard associated with a different transient voice. This voice association may be effected in various ways. It may be associated by keyboard, by keyboard octave area, by multiple octave areas, by upper and lower half of the keyboard, or any other of a number of different ways.

In the preferred embodiment where the number of tone generators is less in number than the number of keys available for selection, it is possible that any actuated key may be assigned to any available tone generator. Therefore a keyboard area latch is provided as a means for storing the keyboard area information associated with an actuated key and for making the information available to the instrument system.

Figures 6A, 7:
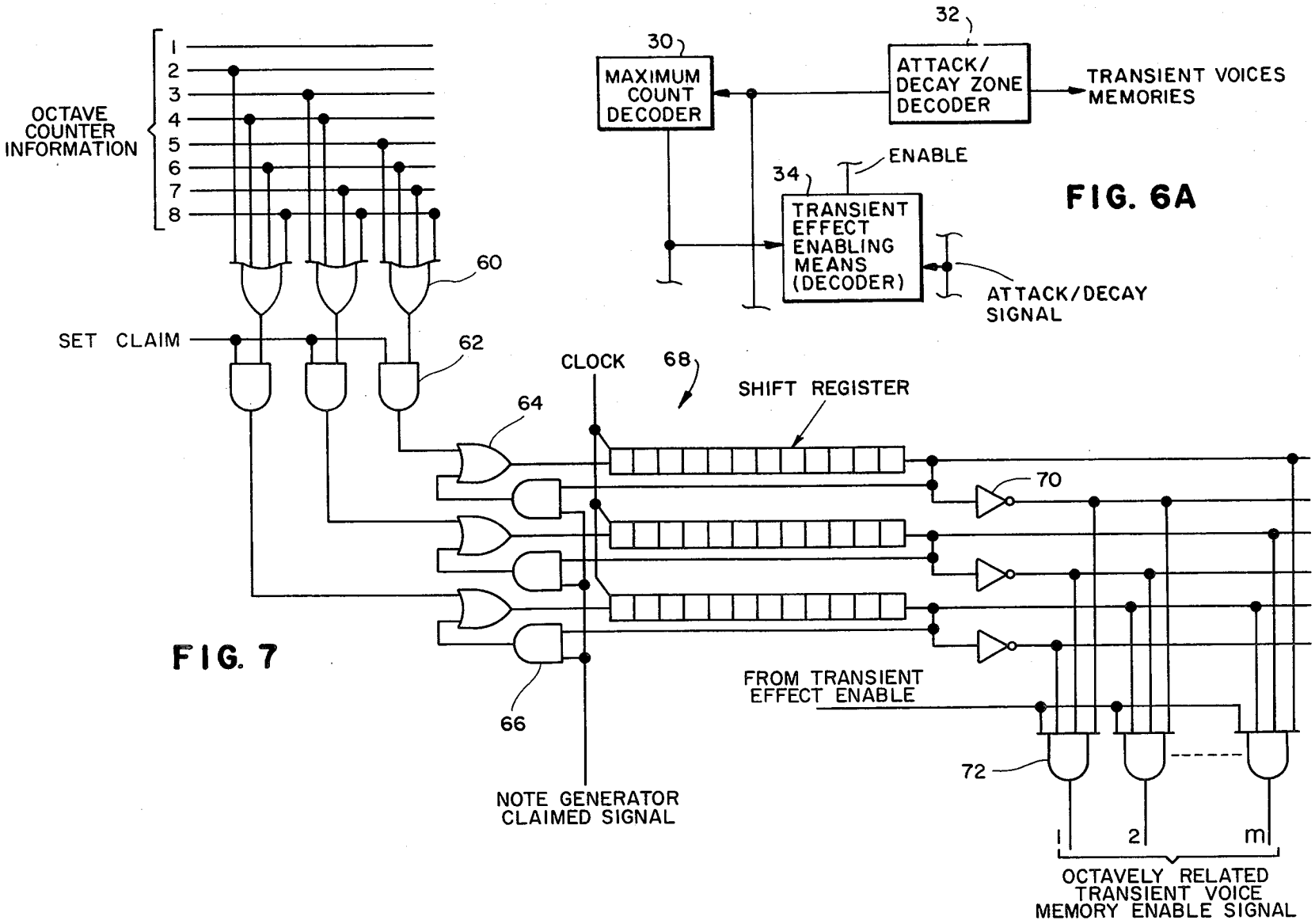
FIG. 6A is a partial block diagram of an alternative embodiment of FIG. 6.
FIG. 7 is a logic diagram of a keyboard area latch used in the multiple memory embodiment in accordance with the present invention.

FIG. 7 is one implementation of a keyboard area latch which will provide keyboard area information. The latch in this embodiment is organized to provide keyboard area information based on an octave relationship; however, it will be obvious that the organization of the keyboard area information may be according to keyboard, note or any other division among or within the keyboard(s). Thus in this example all the keys within an octave will be associated with a particular transient voice. Keyboard octave information from the Keyboard Multiplexer 12 of FIG. 1 (see U.S. Pat. No. 3,610,799 for detailed description of keyboard multiplexer) is encoded as shown in FIG. 7. The method of encoding is binary and will be obvious to those skilled in the art. It should be noted that as a function of the instrument keyboard multiplexer there will always be a positive going pulse on one of the eight keyboard Octave Information lines. The encoded outputs from OR gates 60 are applied in parallel to one input of the respective AND gates 62. The second input to AND gates 62 is the common Set Claim Signal from Generator Assignment Logic 13 of FIG. 1. A detailed description of the Set Claim Signal is given in U.S. Pat. No. 3,610,799 (see FIG. 7B). For the purpose of this description it is sufficient to state the Set Claim Signal is a positive going pulse which is generated when a key among Key Switches 10 of FIG. 1 is newly actuated. As a function of "AND" gate logic the respective gates among AND gates 62 will only have an output when there is coincidence of high logic 1 on Set Claim Signal and the binary code input. The output of the respective AND gates 62 will be applied to one input of the respective OR gate among OR gates 64. The individual output from each OR gate among OR gates 64 is applied individually to its associated shift register among shift registers 68. The number of states in each shift register is equal to the number of tone generator channels in the system. Thus, there is a correlation between the stages in the shift register and a tone generator channel. The signals applied to the shift registers 68 are clocked into the first stage by the system clock. As the tone generator channels are multiplexed, the coded keyboard octave information is shifted through the respective stages of the shift register and is applied to one input of the respective AND gate among AND gates 66. The second input of AND gates 66 receives a common Note Generator Claimed Signal from Generator Assignment Logic 13 of FIG. 1. The Note Generator Claimed Signal is such that the logic "1" indicates a claimed note generator channel and the logic "0" indicates an unclaimed note generator channel. A more detailed description of the Generator Channel Signal is set forth in FIG. 7A, 7B, U.S. Pat. No. 3,610,799. Thus, when a note generator channel is claimed, a logic "1" will be coincident with that of the shift register stage and permit the respective AND gate 66 to pass the coded keyboard octave through to the second input of the associated OR gate among OR gates 64. This logic circuit will be recognized as a recirculating storage loop for the coded keyboard octave information. An unclaimed signal on the Note Generator Claimed Signal will block the recirculation of the coded keyboard octave information; hence, that information will be unlatched.

When information associated with an active key advances to the final stage of the respective shift register, it is presented to a decoder formed by the multiple input AND gates 72. All of the AND gates 72 have a common input which is the Enable signal from Transient Effect Enabling Means 34 of FIG. 1. Referring to FIG. 7, it will be noted that the output of the final stage of the shift register is also simultaneously applied to its associated inverter among invertors 70. The function of the inverters 70 is to assure that only those AND gates among AND gates 72 associated with a shift register stage containing keyboard octave information will have an output. This decoding method is familiar to those skilled in the art. The signals as output by this decoding circuit are applied to their respective memories and perform the function of the Transient Voice Memory enable signal as described hereinabove.

Additionally, as shown in FIG. 6A it is possible to employ the alternate Transient Voice Memory scheme disclosed hereinabove and shown in FIG. 1B. The use of the alternate Transient Voice Memory scheme will permit a total of m·n different transient voices over the keyboard.

The present invention may be embodied in other specific forms without departing from the spirit or essential attributes thereof and, accordingly, reference should be made to the appended claims rather than to the specifications as indicating the scope of the invention.

I claim:

1. In a digital electronic musical instrument having switches selectively actuable to cause the production of sounds corresponding to respective notes of a musical scale, an apparatus for introducing additional voices comprising:

means for generating note attack/decay addresses, first decoder means for decoding said attack/decay addresses and upon decoding a predetermined count outputting a disable signal, means for generating a note attack/decay signal, second decoder means to receive said first decoder output and said attack/decay signal for outputting an enable signal, means for generating sample point addresses, memory means for storing sample point data for a plurality of voice zones and outputting said voice zone sample point data as called for by said sample point addresses in response to said enable signal and said attack/decay addresses.

2. The apparatus of claim 1 wherein said memory means for storing sample point data is a digital programmable read only memory.

3. The apparatus of claim 1 wherein said memory means for storing sample point data is a digital non-programmable read only memory.

4. In a digital electronic musical instrument having switches selectively actuable to cause the production of sounds corresponding to respective notes of a musical scale, an apparatus for introducing additional voices comprising:

means for generating note attack/decay addresses, first decoding means for decoding said attack/decay addresses and upon decoding a predetermined count outputting a disable signal, zone decoding means for decoding said attack/decay addresses and outputting zone enabling signals to the respective zones of a memory, means for generating a note attack/decay signal for distinguishing the attack mode from the decay mode, second decoding means responsive to said first decoder output and said attack/decay signal for outputting an enabling signal to a memory, means for generating sample point addresses, memory means for storing sample point data for a plurality of voice zones and outputting said voice sample point data as called for by said sample point addresses in response to said memory enabling signal and said zone enabling signal.

5. The apparatus of claim 4 wherein said memory means for storing sample point data is a plurality of memories, each memory storing sample point data for a single zone and outputting said voice sample point data as called for by said sample point addresses in response to said memory enabling signal and said zone enabling signal.

6. The apparatus of claim 5 wherein each memory among said plurality of memories for storing sample point data is a digital programmable read only memory.

7. The apparatus of claim 5 wherein each memory among said plurality of memories for storing sample point data is a digital non-programmable read only memory.

8. In a multiplexed digital electronic musical instrument having more switches selectively actuable, then note generators available to cause the production of sounds corresponding to respective notes of a musical scale, an apparatus for introducing additional voices comprising:

means for generating attack/decay addresses, first decoder means for decoding said attack/decay addresses and upon decoding a predetermined count outputting a disable signal, means for generating a note attack/decay signal, second decoder means for receiving said first decoder output and said attack/decay signal for outputting an enabling signal, means for generating keyboard area information data signal, means for generating a note generator claimed signal, means for generating a note generator set claim signal, latch means for receiving said keyboard area information data signal, said note generator claimed signal, said note generator set claim signal and said second decoder enabling signal for outputting a plurality of keyboard associated enabling signals, means for generating sample point addresses, a plurality of memory means equal in number to said plurality of latch means enabling signals, each memory means for storing a plurality of voice zone sample point data and outputting said sample point data as called for by said sample point addresses in response to a respective enabling signal among said plurality of latch means enabling signals and said attack/decay addresses.

9. The apparatus of claim 8 wherein said plurality of memory means for storing sample point data are digital non-programmable read only memories.

10. The apparatus of claim 8 wherein said plurality of memory means for storing sample point data are digital programmable read only memories.

11. In a multiplexed digital electronic musical instrument having more switches selectively actuable than note generator available to cause the production of sounds corresponding to the respective notes of a musical scale, an apparatus for introducing additional voices comprising:

means for generating note attack/decay addresses, first decoder means for decoding said attack/decay addresses and upon decoding a predetermined count outputting a disable signal, zone decoding means for decoding said attack/decay address and outputting "n" zone enable signals, means for generating a note attack/decay signal, second decoder means to receive said first decoder output and said attack/decay signal for outputting an enabling signal, means for generating keyboard area information data signal, means for generating a note generator claimed signal, means for generating a note generator set claim signal, latch means for receiving said keyboard area information data signal, said note generator claim signal, said note generator set claim signal and said second decoder enabling signal for outputting a plurality of keyboard associated enabling signals, means for generating sample point addresses, a plurality of memory means at least equal in number to said "n" zone enable signals for storing voice zone sample point data and outputting said voice zone sample point data as called for by said sample point addresses in response to an associated enable signal among said plurality of latch means enabling signals and an associated zone enable signal among said "n" zone enable signals.

12. The apparatus of claim 11 wherein said plurality of memory means for storing sample point data are digital non-programmable read only memories.

13. The apparatus of claim 11 wherein said plurality of memory means for storing sample point data are digital programmable read only memories.

14. The apparatus of claim 11 wherein said plurality of memory means for storing sample point data equals the product of said latch means enabling signals and said second decoder "n" zone enable signals.

15. The apparatus of claim 14 wherein said plurality of memory means for storing sample point data are digital non-programmable read only memories.

16. The apparatus of claim 14 wherein said plurality of memory means for storing sample point data are digital programmable read only memories.

17. In a digital electronic musical instrument having switches selectively actuable to cause the production of sounds corresponding to respective notes of a musical scale, a method for introducing additional voices comprising:

a. generating note attack/decay addresses, b. decoding said attack/decay addresses and upon decoding a predetermined count outputting a disable signal, c. generating a note attack/decay signal, d. decoding said disable signal and said attack/decay signal and outputting an enable signal, e. generating sample point addresses, f. storing in a memory the sample point data for a plurality of voice zones and outputting said voice zone sample point data as called for by said sample point addresses in response to said enable signal and said attack/decay addresses.

18. In a digital electronic musical instrument having switches selectively actuable to cause the production of sounds corresponding to respective notes of a musical scale, a method for introducing additional voices comprising:

a. generating note attack/decay addresses, b. decoding in a first decoder means said attack/decay addresses and upon decoding predetermined count outputting a disable signal, c. decoding in a zone decoder means said attack/decay and outputting "n" zone enable signals, d. generating a note attack/decay signal, e. decoding in a second decoder means said first decoder output and said attack/decay signal and outputting an enable signal, f. generating a keyboard area information data signal, g. generating a note generator claimed signal, h. generating a note generator set claim signal, i. latching in a latch means said keyboard area information, said note generator claim signal, said note generator set claim signal and said second decoder enable signal and outputting a plurality of keyboard associated enabling signals, j. generating sample point addresses, k. storing in a plurality of memory means at least equal in number to said "n" zone enable signals voice zone sample data and outputting said voice zone sample point data as called for by said sample point addresses in response to an associated enable signal among said plurality of latch means enabling signals and an associated zone enable signal among said second decoder "n" zone enable signals.

* * * * *